US011279386B2

(12) United States Patent
Tubergen

(10) Patent No.: US 11,279,386 B2
(45) **Date of Patent: *Mar. 22, 2022**

(54) SYSTEM TO DETERMINE CLEARANCE OF AN OBSTACLE FOR A VEHICLE SYSTEM

(71) Applicant: Westinghouse Air Brake Technologies Corporation, Wilmerding, PA (US)

(72) Inventor: Gary A. Tubergen, Germantown, MD (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/019,859

(22) Filed: Sep. 14, 2020

(65) Prior Publication Data

US 2020/0406944 A1 Dec. 31, 2020

Related U.S. Application Data

(63) Continuation-in-part of application No. 15/834,970, filed on Dec. 7, 2017, now Pat. No. 10,782,419.

(51) Int. Cl.
*B61L 23/04* (2006.01)
*B61L 25/02* (2006.01)

(52) U.S. Cl.
CPC ..... *B61L 23/041* (2013.01); *B61L 25/025* (2013.01); *B61L 25/026* (2013.01); *B61L 2205/04* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,783,626 | B2 * | 7/2014 | Cross | B61L 15/0072 246/122 R |
| 9,669,851 | B2 * | 6/2017 | Cooper | B61L 23/044 |
| 9,682,716 | B2 * | 6/2017 | Noffsinger | B61L 23/044 |
| 9,834,237 | B2 * | 12/2017 | Plotnikov | B61L 3/18 |
| 9,902,410 | B2 * | 2/2018 | Palmer | B61L 27/0077 |
| 9,981,674 | B1 * | 5/2018 | Palmer | B61L 25/02 |
| 10,308,265 | B2 * | 6/2019 | Fahmy | B61K 9/10 |
| 2002/0123917 | A1 * | 9/2002 | Wolfe | G06Q 10/087 340/5.9 |
| 2005/0107954 | A1 * | 5/2005 | Nahla | B61L 25/025 701/301 |
| 2010/0312461 | A1 * | 12/2010 | Haynie | B61L 25/025 701/117 |

(Continued)

*Primary Examiner* — Mamadou L Diallo
(74) *Attorney, Agent, or Firm* — The Small Patent Law Group LLC; John P. Darling

(57) ABSTRACT

A system includes one or more processors configured to identify first location data corresponding to a first location of a first vehicle of a vehicle system when the first vehicle passes a reference object and identify second location data corresponding to a second location of a second vehicle of the vehicle system. The one or more processors are further configured to determine whether the first location and the second location are within a predetermined distance of each other and in response to determining that the first and second locations are within the predetermined distance of each other, and generate a signal related to a condition that the first location and the second location are within the predetermined distance.

20 Claims, 5 Drawing Sheets

(56) References Cited

U.S. PATENT DOCUMENTS

| | | | | |
|---|---|---|---|---|
| 2015/0302752 | A1* | 10/2015 | Holihan | B61L 23/00 246/62 |
| 2018/0086263 | A1* | 3/2018 | Moradi-Pari | B60W 50/14 |
| 2018/0302403 | A1* | 10/2018 | Souders | H04L 63/107 |
| 2019/0279506 | A1* | 9/2019 | Kelgernon | G08G 1/0965 |
| 2020/0007227 | A1* | 1/2020 | Becker | H04B 7/18543 |
| 2020/0118422 | A1* | 4/2020 | Demisse | H04W 4/44 |

* cited by examiner

SYSTEM TO DETERMINE CLEARANCE OF AN OBSTACLE FOR A VEHICLE SYSTEM

CROSS REFERENCE TO RELATED APPLICATION

This application is a continuation-in-part of U.S. application Ser. No. 15/834,970, filed Dec. 7, 2017, now allowed, the entire contents of which are incorporated herein by reference.

BACKGROUND

Technical Field

The present subject matter relates to the safe movement of two vehicle systems, for example trains, through an intersection of routes of the vehicle systems and, more particularly, when one vehicle system travelling through the intersection, has moved a distance away from the intersection to permit the safe movement of another vehicle system through the intersection in a manner to avoid contact with the one vehicle system.

Discussion of Art.

Operations of vehicle systems that include a plurality of vehicles joined together, for example railroad operations, often require a determination when the rear of a first train is clear of the intersection of a pair of tracks, such as track switch or siding opening, such that a second train can safely pass through the intersection without contacting the first train. In the past, personnel in the final car. e.g., the caboose, of the first train or walking alongside the track proximate the rear car of the first train would visually confirm clearance of track intersections. However, when cabooses were removed from trains other methods had to be used because there was no guarantee that such personnel were readily available to visually confirm such clearance.

One other method is to use an odometer in the locomotive in conjunction with the known length of the train to determine the distance traveled from the intersection and determine the location of the last car relative to the intersection. If the train length is not accurately known, however, the position of the last car could not be determined.

BRIEF DESCRIPTION

In accordance with one embodiment, a system may include one or more processors configured to identify first location data corresponding to a first location of a first vehicle of a vehicle system when the first vehicle passes a reference object and identify second location data corresponding to a second location of a second vehicle of the vehicle system. The one or more processors may further be configured to determine whether the first location and the second location are within a predetermined distance of each other and in response to determining that the first and second locations are within the predetermined distance of each other, and generate a signal related to a condition that the first location and the second location are within the predetermined distance.

In accordance with one embodiment, a system may include one or more processors configured to identify a first location of a first vehicle moving through an intersection that includes a reference object as the first vehicle moves proximate the reference object in a direction from the intersection toward the marker and identify a second location of a second vehicle interconnected with the first vehicle during movement proximate the reference object in the direction from the intersection toward the reference object. The one or more processors may further be configured to repeat sampling of the second location until the second location is within a predetermined distance of the first location and generate a signal indicating that the second location is within the predetermined distance of the first location.

BRIEF DESCRIPTION OF THE DRAWINGS

The inventive subject matter may be understood from reading the following description on non-limiting embodiments, with reference to the attached drawings, wherein below.

DETAILED DESCRIPTION

Figure 1:
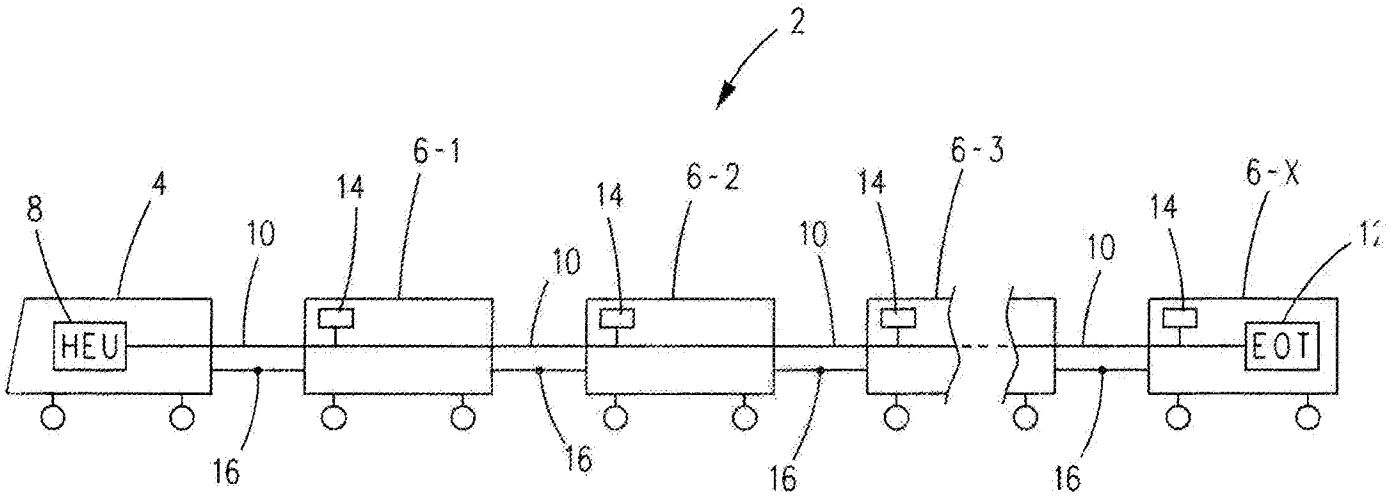
FIG. 1 is a schematic illustration of an example train that includes a lead rail vehicle, e.g. a locomotive, and X trailing rail vehicles or rail cars.

Various non-limiting examples will now be described with reference to the accompanying figures where like reference numbers correspond to like or functionally equivalent elements.

For purposes of the description hereinafter, the terms "end," "upper," "lower," "right," "left." "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example(s) illustrated in the attached drawings, and described in the following specification, are simply exemplary examples or aspects of the invention. Hence, the specific examples or aspects disclosed herein are not to be construed as limiting.

The vehicle systems described herein can be formed from a single vehicle or from two or more vehicles traveling together. With respect to two or more vehicles, the vehicles may be mechanically coupled with each other, such as by couplers, or may be separate from each other but communicate with each other so that the vehicles can coordinate the respective movements of the vehicles and travel together as a vehicle system. The vehicles may be rail vehicles (e.g. locomotives and/or rail cars), or other types of vehicles, such as automobiles, trucks, buses, mining vehicles, etc.

With reference to FIG. 1, in one embodiment, a train 2 can include a locomotive 4 and a number of cars 6-1-6-X, where "X" can be any whole number greater than or equal to 2. In the example train 2 shown in FIG. 1, locomotive 4 is the lead vehicle of the train and car 6-X is the last vehicle of train 2. However, this is not to be construed in a limiting sense since it is envisioned that the lead vehicle of train 2 can be a car 6 other than locomotive 4, e.g., locomotive 4 can be positioned in train 2 between the lead vehicle and the last vehicle. For the purpose of the following description, locomotive 4 will be the lead vehicle of train 2.

In one embodiment, locomotive 4 can include a head-end-unit (HEU) 8. HEU 8 can be coupled via a trainline 10 to an end of train (EOT) device 12 which, in a non-limiting embodiment or example, can be included in car 6-X. Optionally, HEU 8 can be coupled via trainline 10 to an electronically controlled pneumatic (ECP) controller 14 in each car 6. Each ECP controller 14 can respond to electronic braking commands from HEU 8 for controlling the brakes of each car.

In one embodiment, mechanical couplers 16 can be utilized to couple proximate cars 6 to each other and to couple locomotive 4 to car 6-1 in a manner known in the art. Train 2 can include additional elements which are not shown in the figures for the purpose of simplicity. For example, it is understood that locomotive 4 includes a motor or engine that is utilized to provide motive force to train 2.

Figure 2:
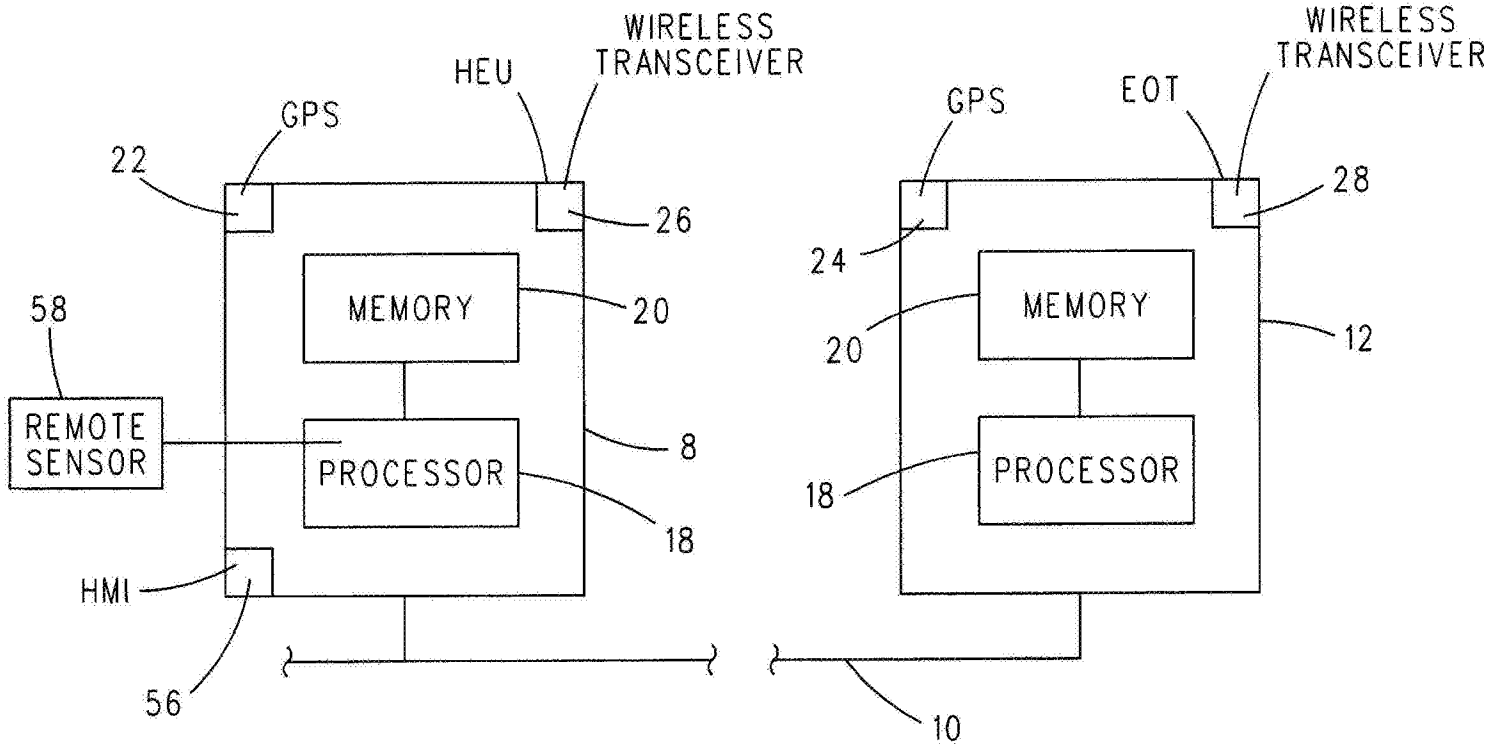
FIG. 2 is a schematic illustration of example elements. E.g., a processor and memory, comprising the head-end-unit (HEU) of the lead rail vehicle of the train and an end-of-train unit (EOT) disposed on the last rail vehicle of the train, and a trainline connecting the HEU and the EOT in communication.

With reference to FIG. 2 and with continuing reference to FIG. 1, in a non-limiting embodiment or example, trainline 10 acts in the nature of a communication network, such as, for example, without limitation, a local area network (LAN), between HEU 8 and at least EOT 12. EOT 12 can be mounted to the last vehicle of train 2 e.g., car 6-X, in lieu of a caboose. In a non-limiting embodiment or example, EOT 12 can be the terminal end of trainline 10 opposite HEU 8. However, this is not to be construed in a limiting sense.

In a non-limiting embodiment or example, HEU 8 and EOT 12 each include a processor 18 communicatively coupled to trainline 10 and a memory 20 coupled to processor 18 and operative for storing software control program(s) and/or operational data.

In non-limiting embodiment or example, herein, "controller" can include one or more processors 18 of HEU 8 and/or EOT 12. Hence, when discussing processing by a controller, it is to be understood that such processing can be performed by either one or both of processors 18 of HEU 8 and EOT 12. However, this is not to be construed in a limiting sense.

In one embodiment, each memory 20 can include dynamic, volatile memory, e.g., RAM, that loses program code and data stored therein when power to memory 20 is lost or when overwritten by the corresponding processor 18, and a non-volatile memory. e.g., ROM, flash memory and the like, the latter of which (non-volatile) memory, can store at least, an embedded operating system and embedded data for use by the corresponding HEU 8 or EOT 12 processor 18 in the presence or absence of power being applied to the non-volatile memory of said processor 18. In one embodiment, HEU 8 and EOT 12 can receive electrical power for their operation via trainline 10 from a battery or generator of locomotive 4.

In one embodiment, HEU 8 can include or be coupled to a GPS receiver 22 disposed in locomotive 4 and EOT 12 can include or be coupled to a GPS receiver 24 disposed in car 6-X.

In one embodiment, trainline 10 can be a wired network, a wireless network, or a combination of both a wired and a wireless network. In a non-limiting embodiment or example, HEU 8 and EOT 12 can be in communication wirelessly, e.g., via wireless transceivers 26 and 28 of HEU 8 and EOT 12.

Figure 3A:
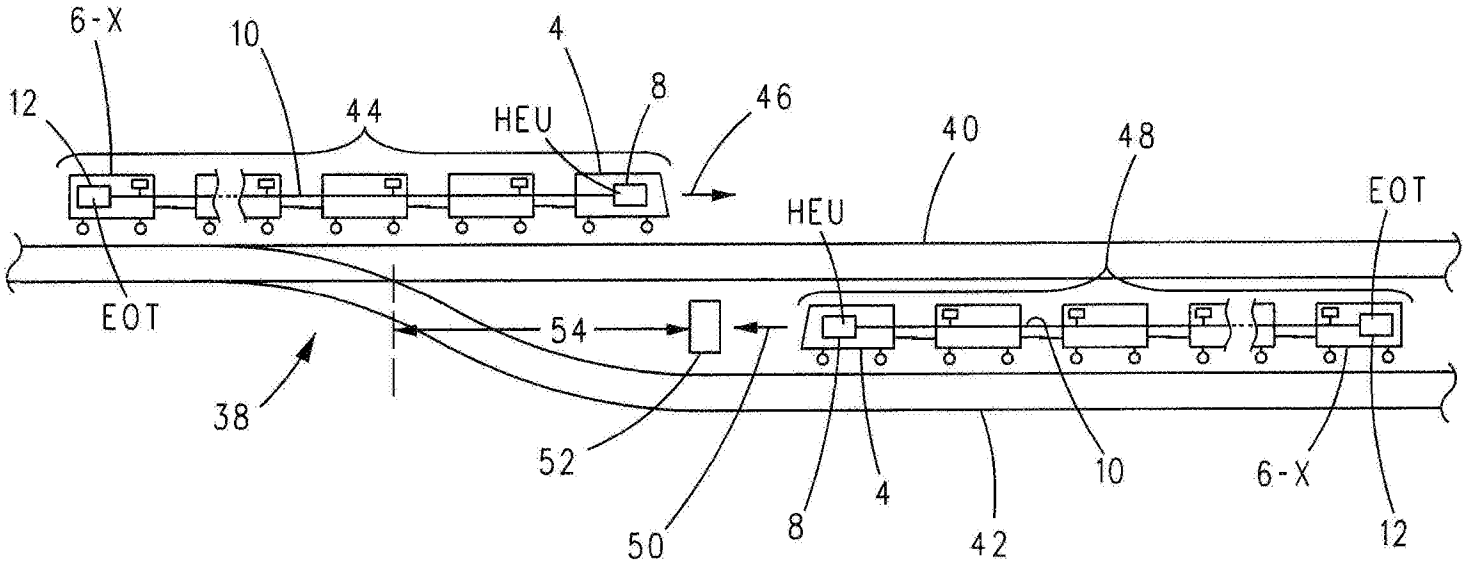
FIGS. 3A-3B are schematic illustrations of an intersection of first and second train tracks that includes a marker between said first and second train tracks, showing first and second positions of a first train travelling on the first track moving a distance away from the intersection to allow a second train on the second track to move through the intersection without risk of collision or contact with the first train in accordance with the principles described herein.
Figure 3B:
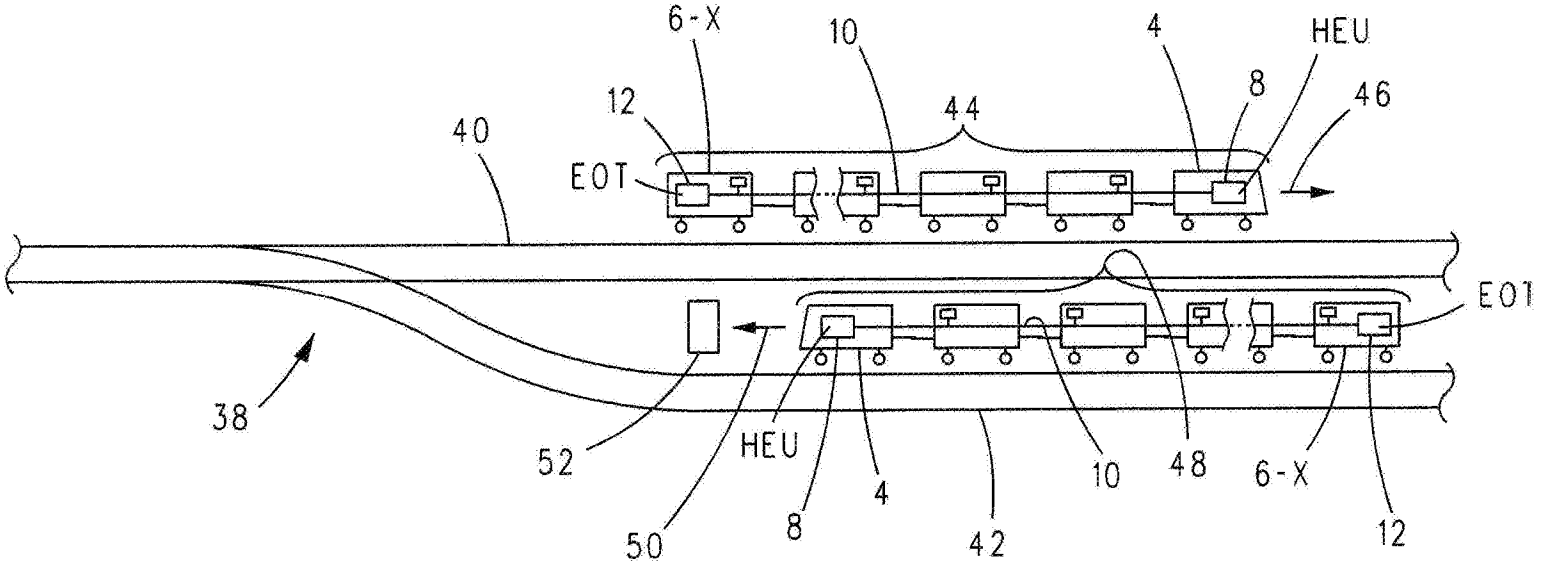

In one embodiment, with reference to FIGS. 3A-3B and with continuing reference to FIGS. 1 and 2, common to track networks worldwide is an intersection 38 (e.g., a track switch) where a first track 40 and a second track 42 come together. As an aid to avoiding contact or collision between a first train 44 (similar to train 2) traveling on first track 40 in a first direction 46 (to the right in FIG. 3A) and a second train 48 (similar to train 2) traveling on second track 42 in a second direction 50 (to the left in FIG. 3A) a reference object in the form of a marker 52 can be placed between first and second tracks 40, 42 a distance 54 away from intersection 38 of said first and second tracks 40, 42.

In one embodiment, in FIG. 3A, distance 54 is for the purpose of illustration only and is not to be construed in a limiting sense since the actual distance 54 that marker 52 is placed from the intersection 38 of first and second tracks 40, 42 depends on a number of factors, including a curvature of track 42 at and proximate to intersection 38, the dimensions of vehicles of trains 44 and/or 48, and the like.

In the industry, marker 52 is also known as a fouling mark. A typical marker 52 is made of concrete or cement. However, this is not to be construed in a limiting sense since it is envisioned that marker 52 can be of any suitable and/or desirable design and can be made of any suitable and/or desirable material. It should also be understood that the reference object may be any object that may serve as a reference location for the vehicle system.

In one embodiment, with ongoing reference to FIGS. 3A and 3B, from a starting condition where first train 44 is positioned to the left of marker 52 traveling from left to right through intersection 38 and second train 48 desires to pass from right to left through intersection 38, in order to allow safe passage of both trains 44 and 48 the front of vehicle 4 of second train 48 is positioned before (to the right) of marker 52. This will ensure that first train 44 can pass through intersection 38 in the first direction 46 without contacting or colliding with second train 48. To enable the detection of when car 6-X of first train 44 moving in the first direction 46 has cleared intersection 38 a distance to allow second train 48 to move through intersection 38 without contacting or colliding any vehicle 4 or 6 of first train 44. GPS receiver 22 of HEU 8 and GPS receiver 24 of EOT 12 can be utilized in the manner described next.

In one embodiment, when locomotive 4 of first train 44 moving in the first direction 46 is proximate to or passes marker 52, an indication of this passage can be input into the controller, for example processor 18 of HEU 8. In one embodiment, this indication can be input into the controller by, for example, an operator of train 44 via a human machine interface (HMI) 56 of HEU 8. In one embodiment, the controller, for example processor 18 of HEU 8, can determine from data supplied thereto by a remote sensor 58, such as a camera of train 44, when locomotive 4 of first train 44 moving in a direction 46 is proximate to or passes marker 52 and can, based on this determination, automatically generate this indication.

In response to this indication, the controller, for example processor 18 of HEU 8, identifies first location data, for example GPS data output by GPS receiver 22 of HEU 8. This first GPS data corresponds to the geographical location of locomotive 4 of first train 44 traveling on first track 40 when locomotive 4 is proximate to or passes marker 52. In a non-limiting embodiment or example, this first GPS data can be communicated to processor 18 of EOT 12 via trainline 10.

Thereafter, as first train 44 continues moving in direction 46, the controller, for example processor 18 of EOT 12, identifies a number of second location data, for example GPS data from second GPS receiver 24 and compares each identified second GPS data to the first GPS data identified from GPS receiver 22. The process of identifying multiple second GPS data from second GPS receiver 24 and comparing each identified second GPS data to the first GPS data acquired from first GPS receiver 22 continues until the controller, e.g., for example processor 18 of EOT 12, determines that the geographical location corresponding to the first GPS data and the geographical location corresponding to the second GPS data are within a predetermined distance of each other.

In response to the controller determining that the first and second geographical locations are within the predetermined distance of each other, the controller generates a signal. In one embodiment, this signal relates to the condition that the first train 44 has traveled on first track 40 in the first direction 46 away from the intersection 38 distance 54. e.g., sufficient to permit travel of second train 48 in the second direction 50 through intersection 38 without risk of collision or contact between first and second trains 44 and 48.

In one embodiment, the "predetermined distance" used by the controller as a basis for generating the signal can be selected based on the GPS receiver 22 or 24 having the lowest GPS resolution or accuracy, also known as ranging error. To this end, two GPS receivers positioned at the same location may output different GPS data depending on the GPS resolution or accuracy of each GPS receiver. The accuracy of any GPS receiver can be based on factors such as GPS satellite geometry, ranging error and local factors such as signal blockage, atmospheric conditions, and receiver design features/quality.

To account for this in accordance with the principles described herein, when the controller determines that the first and second geographical locations corresponding to the first and second GPS data are within a predetermined distance of each other, the controller, e.g., the processor 18 of EOT 12, is programmed to assume that the first and second geographical locations are a distance close to each other to be considered the same for the purposes of determining that car 6-X is proximate to or has passed marker 52, whereupon second train 48 on second track 42 can move through intersection 38 without risk of collision or contact with first train 44.

In one embodiment, the predetermined distance can be less than or equal to 4 cm. In one embodiment, the predetermined distance can be 0 cm, i.e., the controller determines that the first and second geographical locations corresponding to the first and second GPS data are the same geographical locations.

In one embodiment, in practice, the use of this predetermined distance between the first and second geographical locations is a valid indication that first train 44 has cleared intersection 38 past marker 52 to permit second train 48 to pass through intersection 38 without risk of collision or contact with first train 44, regardless if second train 48 was stationary or moving when it was determined that the first and second geographical locations are within the predetermined distance of each other.

In one embodiment, to ensure that first train has moved in the first direction 46 a distance past marker 52 (more than distance 54) to permit the safe passage of second train 48 through intersection 38, the controller can delay generating the signal an additional time or distance after determining that the first and second geographical locations are within the predetermined distance of each other.

In one embodiment, the signal generated by the controller of first train 44 can be communicated to second train 48 in any suitable or desirable manner. In one embodiment, the signal can be communicated to second train 48 via a wireless signal output by one of the wireless transceivers 26, 28 of first train 44. This wireless signal can be received by one or more wireless transceivers 26 and/or 28 of the HEU and/or EOT of second train 48. Upon receipt of this signal, a corresponding human perceivable indication can be output to the operator of second train 48. This human perceivable indication can be an audio indication, a visual indication, or a combination thereof.

In one embodiment, comparison of each identified second GPS data acquired by GPS receiver 24 to the first GPS data acquired by GPS receiver 22 can occur at EOT 12, for example, processor 18 of EOT 12. However, this is not to be construed in a limiting sense since it is envisioned that this comparison can occur at HEU 8.

In one embodiment, the first GPS data can be acquired in response to user input. For example, an operator of train 44 can, via HMI 56 of HEU 8, input into the controller, for example processor 18 of HEU 8, an indication when locomotive 4 has passed or is adjacent to or proximate marker 52.

Figure 4:
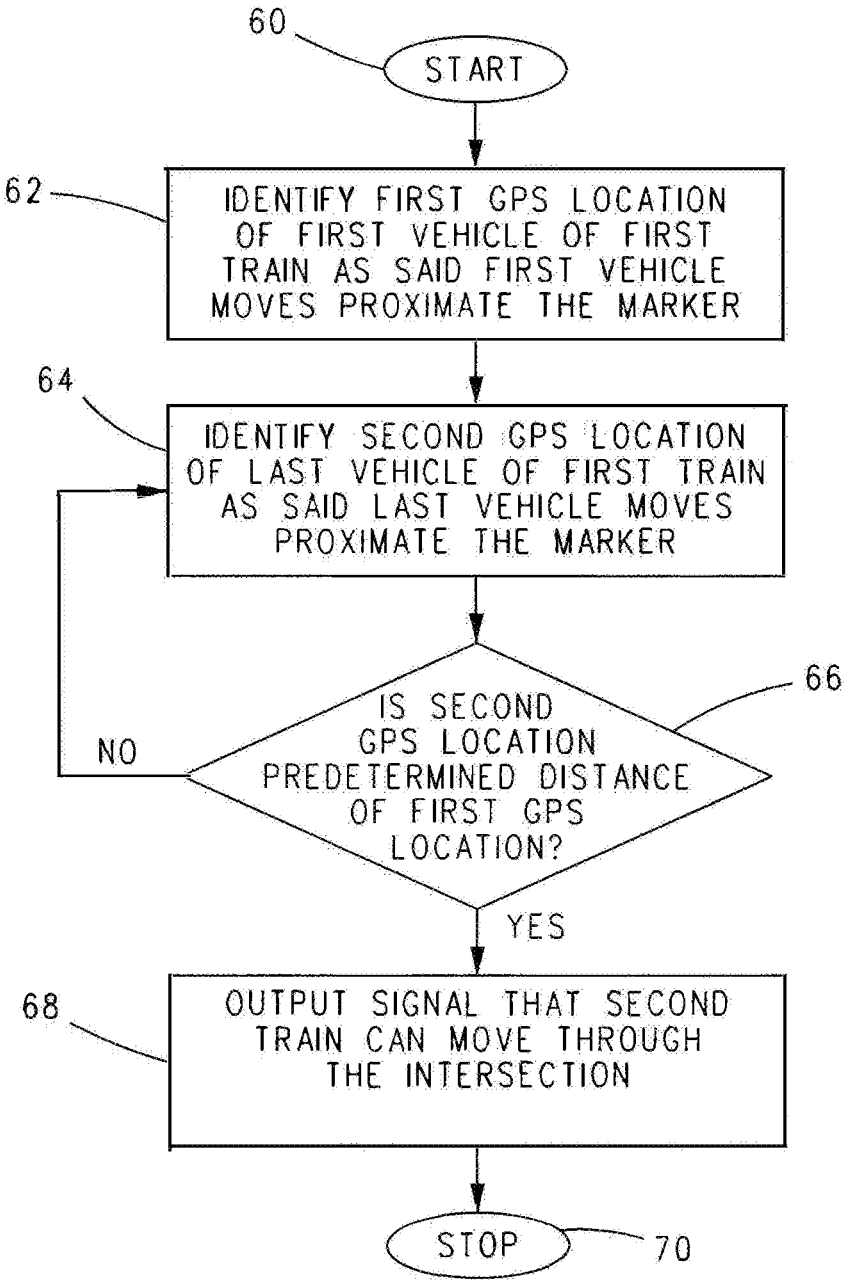
FIG. 4 is a method in accordance with the principles described herein.

With reference to the flow diagram of FIG. 4 and with continuing reference to FIGS. 1-3B, a method according to one embodiment starts by advancing from a Start step 60 to step 62 wherein a first GPS location of the first vehicle 4 (e.g., locomotive) of first train 44 is identified as the first vehicle 4 moves proximate marker 52 in a direction away from intersection 38.

The method then advances to step 64 wherein a second GPS location of the last vehicle 6-X (e.g., locomotive) of the train 44 is identified as the other vehicles 6 of first train 44 move proximate marker 52 in a direction away from the intersection 38. In step 66, it is determined if the second GPS location is within the predetermined distance of the first GPS location. If not, the method repeats steps 64 and 66 until, in an instance of step 66, it is determined that the second GPS location is indeed within the predetermined distance of the first GPS location. Thereafter, at step 68 a signal is output indicating that first train 44 has cleared intersection 38 and has moved at least past marker 52 in a direction away from intersection 38 such that the second train 48 can safely pass through intersection 38 without risk of contact with the first train 44. Thereafter, the method advances to Stop step 70, whereupon the method terminates.

The method shown in FIG. 4 can be repeated each time first train 44 passes through an intersection 38 of first and second tracks 40, 42 that includes a marker 52 between said first and second tracks 40, 42.

As can be seen, disclosed is a method of determining, for an intersection 38 of first and second train tracks 40, 42 that includes a marker 52 between said first and second train tracks 40, 42, when a first train 44 on the first track 40 has traveled away from the intersection 38 a distance to permit travel of a second train 48 on the second track 42 through the intersection 38 without risk of collision or contact between the first and second trains 44, 48, wherein the first train 44 includes a controller comprising one or more processors 18. The method comprises: (a) identifying, by the controller, first GPS data corresponding to a first geographical location of a lead vehicle 4 of the first train 44 travelling on the first track 40 when the lead vehicle 4 passes proximate the marker 52; (b) following step (a), identifying, by the controller, second GPS data corresponding to a second geographical location of a last vehicle 6-X of the first train 44 moving on the first track 40; (c) following step (b), comparing, by the controller, the second GPS data and the first GPS data; (d) repeating steps (b)-(c) until the controller determines that the first geographical location corresponding to the first GPS data and the second geographical location corresponding to the second GPS data are within a predetermined distance of each other; and (e) in response to the controller determining that the first and second geographical locations are within the predetermined distance of each other, the controller generating a signal related to the condition that the first train 44 has traveled on the first track away from the intersection 38 said distance.

The first train 44 can travel in the first direction 46 from the intersection 38 toward the marker 52. Following step (e), the second train 48 can travel in the second direction 50 from the marker 52 toward the intersection 38.

Step (e) can include the controller delaying generating the signal until the first train 44 has moved an additional time or distance after determining that the first and second geographical locations are within the predetermined distance of each other.

The controller can comprise an end-of-train device (EOT) 12 disposed on the last vehicle 6-X of the first train 44.

The first GPS data can be identified by the controller from a first GPS receiver 22 disposed on the lead vehicle 4 of the first train 44. The second GPS data can be sampled by the controller from a second GPS receiver 24 disposed on the last vehicle 6-X of the first train 44.

The comparison of step (c) can occur at an end-of-train device (EOT) disposed on the last vehicle of the first train. The EOT can receive the first GPS data via a communication network 10.

The first GPS data can be identified in response to user input, e.g., via HMI 56.

The method can further include confirming, by a remote sensor (e.g., a camera) 58, the presence of the marker 52 proximate the lead vehicle 4 of the first train 44.

Also disclosed herein is a method of determining, for an intersection 38 of first and second train tracks 40, 42 that includes a marker 52 between said first and second train tracks 40, 42, that a first train 44 travelling on the first track 40 has moved a distance away from the intersection 38 to allow a second train 48 on the second track 42 to move through the intersection 38 without risk of collision or contact with the first train 44. The method comprises: (a) identifying, by a controller of the first train 44. GPS data related to a geographical location of one vehicle 4 of the first train 44 passing proximate the marker 52, wherein the controller comprises one or more processors; (b) following step (a), identifying, by the controller, GPS data related to a geographical location of another vehicle 6-X of the first train 44; (c) determining, by the controller, if the geographical location of the GPS data identified in step (a) and the geographical location of the GPS data identified in step (b) are within a predetermined distance of each other; (d) if, in step (c), the controller determines that the geographical location of the GPS data identified in step (a) and the geographical location of the GPS data identified in step (b) are not within the predetermined distance of each other, the controller repeats steps (b) and (c) until the geographical location of the GPS data identified in step (a) and the geographical location of the GPS data identified in step (b) are within the predetermined distance of each other; and (e) generating, by the controller, a signal indicating that the first train 44 has moved said distance.

Step (e) can further include the controller delaying generating the signal until the first train 44 has moved an additional time or distance after determining that the first and second geographical locations are within the predetermined distance of each other.

The signal can be communicated to the second train 48.

The first train 44 can travel on the first track from the intersection 38 toward the marker 52. Following step (e), the second train 48 can travel on the second track 42 from the marker 52 toward the intersection 38.

The one vehicle of the first train can be a lead vehicle 4 of the first train. The other vehicle of the first train can be the last vehicle 6-X of the first train. The lead vehicle can be a locomotive.

The GPS data in step (a) can be identified from a first GPS receiver on-board the one vehicle. The GPS data in step (b) can be identified from a second GPS receiver on-board the other vehicle.

The determining of step (c) can occur at an end-of-train device (EOT) disposed on the last vehicle of the first train. The EOT can receive the GPS data in step (a) via a train communication network.

The GPS data in step (a) can be identified in response to user input.

The method can further include, confirming, by a remote sensor 58, the presence of the marker proximate the one vehicle of the first train.

Also disclosed herein is a method comprising: (a) identifying a first GPS location of a first vehicle 4 of a first train 44 moving through an intersection 38 of first and second tracks 40, 42 that includes a marker 52 between said first and second tracks 40, 42 said first vehicle 4 moves proximate said marker 52 in a direction from the intersection 38 toward the marker 52; (b) identifying a second GPS location of the last vehicle 6-X of the first train 44 as the other vehicles 6 of the first train 44 move proximate the marker 52 in a direction from the intersection 38 toward the marker 52; (c) following step (b), if the second GPS location is not within a predetermined distance of the first GPS location, repeat step (b) until it is determined that the second GPS location is within the predetermined distance of the first GPS location; and (d) following step (c), outputting a signal indicating that the second GPS location is within the predetermined distance of the first GPS location.

The predetermined distance can be greater than or equal to 4 cm, or greater than or equal to 1 meter, or greater than or equal to 3 meters.

A system may include one or more processors. The one or more processors may be configured to identify first location data corresponding to a first location of a first vehicle of a vehicle system when the first vehicle passes a reference object and identify second location data corresponding to a second location of a second vehicle of the vehicle system. The one or more processors may further be configured to determine whether the first location and the second location are within a predetermined distance of each other and in response to determining that the first and second locations are within the predetermined distance of each other, generate a signal related to a condition that the first location and the second location are within the predetermined distance Optionally, the one or more processors may be configured to determine whether the first location and the second location are within the predetermined distance of each other by comparing the second location data and the first location data and repeating identifying of the second location data and repeating the comparing until the first location and the second location are within the predetermined distance.

Optionally, determining that the first and second locations are within the predetermined distance of each other may include delaying generating the signal until the vehicle system has moved one or more of an additional time or an additional distance after determining that the first and second locations are within the predetermined distance of each other.

Optionally, the one or more processors may include a first processor disposed on the first vehicle of the vehicle system configured to identify the first location data and a second processor disposed on the second vehicle of the vehicle system configured to identify the second location data. Optionally, the second processor may be configured to compare the second location data and the first location data and the second processor may be configured to receive the first location data via a communication network.

Optionally, the system may also include a first receiver disposed on the first vehicle of the vehicle system configured to receive the first location data and a second receiver disposed on the second vehicle of the vehicle system configured to receive the second location data. Optionally, one or more of the first receiver or the second receiver may include a GPS receiver.

Optionally, the one or more processors may be configured to identify the first location data in response to user input. Optionally, the one or more processors may be configured to confirm, by a remote sensor, a presence of the reference object proximate the first vehicle of the vehicle system. Optionally, the one or more processors may be configured to automatically identify the first location data upon confirmation of the presence of the reference object proximate the first vehicle of the vehicle system.

Optionally, the one or more processors may be further configured to communicate the signal to a second vehicle system. Optionally, the first vehicle may be a lead vehicle of the vehicle system and the second vehicle may be a last vehicle of the vehicle system. Optionally, the lead vehicle may be a locomotive.

Optionally, the first location data and the second location may be identified from a first receiver on-board the first vehicle and a second receiver on-board the second vehicle, respectively. Optionally, the predetermined distance is four centimeters or less.

A system may include one or more processors. The one or more processors may be configured to identify a first location of a first vehicle moving through an intersection that includes a reference object as the first vehicle moves proximate the reference object in a direction from the intersection toward the marker and identify a second location of a second vehicle interconnected with the first vehicle during movement proximate the reference object in the direction from the intersection toward the reference object. The one or more processors may be further configured to repeat identifying of the second location until the second location is within a predetermined distance of the first location and generate a signal indicating that the second location is within the predetermined distance of the first location.

Optionally, the one or more processors may be configured to identify the first location in response to user input. Optionally, the one or more processors may be configured to confirm, by a remote sensor, a presence of the reference object proximate the first vehicle of the vehicle system.

Optionally, the one or more processors may be configured to automatically identify the first location upon confirmation of the presence of the reference object proximate the first vehicle of the vehicle system. Optionally, the system may further include a first receiver disposed on the first vehicle of the vehicle system configured to receive the first location and a second receiver disposed on the second vehicle of the vehicle system configured to receive the second location. Optionally, one or more of the first receiver or the second receiver may include a GPS receiver.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

The invention claimed is:

1. A system comprising:

one or more processors configured to identify first location data corresponding to a first location of a first vehicle of a vehicle system when the first vehicle passes a reference object;

identify second location data corresponding to a second location of a second vehicle of the vehicle system;

determine whether the first location and the second location are within a predetermined distance of each other; and in response to determining that the first and second locations are within the predetermined distance of each other, generate a signal related to a condition that the first location and the second location are within the predetermined distance.

2. The system of claim 1, wherein the one or more processors are configured to determine whether the first location and the second location are within the predetermined distance of each other by comparing the second location data and the first location data and repeating identifying of the second location data and repeating the comparing until the first location and the second location are within the predetermined distance.

3. The system of claim 1, wherein determining that the first and second locations are within the predetermined distance of each other includes delaying generating the signal until the vehicle system has moved one or more of an additional time or an additional distance after determining that the first and second locations are within the predetermined distance of each other.

4. The system of claim 1, wherein the one or more processors comprise:

a first processor disposed on the first vehicle of the vehicle system configured to identify the first location data; and a second processor disposed on the second vehicle of the vehicle system configured to identify the second location data.

5. The system of claim 4, wherein the second processor is configured to compare the second location data and the first location data and the second processor is configured to receive the first location data via a communication network.

6. The system of claim 4, further comprising:

a first receiver disposed on the first vehicle of the vehicle system configured to receive the first location data; and a second receiver disposed on the second vehicle of the vehicle system configured to receive the second location data.

7. The system of claim 6, wherein one or more of the first receiver or the second receiver comprises a GPS receiver.

8. The system of claim 1, wherein the one or more processors are configured to identify the first location data in response to user input.

9. The system of claim 1, wherein the one or more processors are configured to confirm, by a remote sensor, a presence of the reference object proximate the first vehicle of the vehicle system.

10. The system of claim 9, wherein the one or more processors are configured to automatically identify the first location data upon confirmation of the presence of the reference object proximate the first vehicle of the vehicle system.

11. The system of claim 1, wherein the one or more processors are further configured to communicate the signal to a second vehicle system.

12. The system of claim 1, wherein the first vehicle is a lead vehicle of the vehicle system and the second vehicle is a last vehicle of the vehicle system.

13. The system of claim 12, wherein the lead vehicle is a locomotive.

14. The system of claim 12, wherein the first location data and the second location are identified from a first receiver on-board the first vehicle and a second receiver on-board the second vehicle, respectively.

15. The system of claim 1, wherein the predetermined distance is four centimeters or less.

16. A system comprising:

one or more processors configured to identify a first location of a first vehicle moving through an intersection that includes a reference object as the first vehicle moves proximate the reference object in a direction from the intersection toward the marker;

identify a second location of a second vehicle interconnected with the first vehicle during movement proximate the reference object in the direction from the intersection toward the reference object;

repeat identifying of the second location until the second location is within a predetermined distance of the first location; and generate a signal indicating that the second location is within the predetermined distance of the first location.

17. The system of claim 16, wherein the one or more processors are configured to identify the first location in response to user input.

18. The system of claim 16, wherein the one or more processors are configured to confirm, by a remote sensor, a presence of the reference object proximate the first vehicle of the vehicle system.

19. The system of claim 18, wherein the one or more processors are configured to automatically identify the first location upon confirmation of the presence of the reference object proximate the first vehicle of the vehicle system.

20. The system of claim 16, further comprising:

a first receiver disposed on the first vehicle of the vehicle system configured to receive the first location; and a second receiver disposed on the second vehicle of the vehicle system configured to receive the second location, wherein one or more of the first receiver or the second receiver comprises a GPS receiver.

* * * * *